US007114822B2

(12) United States Patent
Guzman

(10) Patent No.: US 7,114,822 B2
(45) Date of Patent: Oct. 3, 2006

(54) ARTICLE OF FOOTWEAR WITH REMOTE SOUND ACTIVATING UNIT

(75) Inventor: Rudy Guzman, Coral Springs, FL (US)

(73) Assignee: BBC International, Ltd., Boca Raton, FL (US)

( * ) Notice: Subject to any disclaimer, the term of this patent is extended or adjusted under 35 U.S.C. 154(b) by 161 days.

(21) Appl. No.: 10/988,320

(22) Filed: Nov. 12, 2004

(65) Prior Publication Data

US 2006/0104046 A1 May 18, 2006

(51) Int. Cl.
*F21V 23/04* (2006.01)
*A43B 23/24* (2006.01)
*G11B 33/06* (2006.01)
*G08B 1/08* (2006.01)

(52) U.S. Cl. ..... 362/103; 362/86; 362/394; 36/137; 36/139; 340/539.11

(58) Field of Classification Search ..... 362/103, 362/86, 394; 36/137, 139; 340/539.11
See application file for complete search history.

(56) References Cited

U.S. PATENT DOCUMENTS

| | | | | |
|---|---|---|---|---|
| 4,063,410 | A | 12/1977 | Welling | 58/38 R |
| 4,660,305 | A * | 4/1987 | Medler et al. | 36/139 |
| 5,159,768 | A | 11/1992 | Longo, Jr. | 36/139 |
| 5,345,700 | A | 9/1994 | Norment | 36/139 |
| 5,461,188 | A * | 10/1995 | Drago et al. | 36/137 |
| 5,471,405 | A | 11/1995 | Marsh | 364/556 |
| D370,855 | S | 6/1996 | Hanagata | D10/31 |
| 5,557,259 | A | 9/1996 | Musa | 340/573 |
| 5,649,376 | A | 7/1997 | Lecates, Jr. | 36/137 |
| 5,714,706 | A | 2/1998 | Nakada et al. | 84/730 |
| 5,748,087 | A | 5/1998 | Ingargiola et al. | 340/573.7 |
| 5,765,300 | A | 6/1998 | Kianka | 36/139 |
| 5,797,201 | A | 8/1998 | Huang | 36/132 |
| 5,812,063 | A | 9/1998 | Weng et al. | 340/815.45 |
| 5,813,148 | A | 9/1998 | Guerra | 36/137 |
| 5,855,080 | A | 1/1999 | Van Staden | 36/139 |
| 5,875,571 | A | 3/1999 | Huang | 36/132 |
| 5,894,201 | A | 4/1999 | Wong | 315/241 S |
| 5,894,686 | A | 4/1999 | Parker et al. | 36/137 |
| 5,899,963 | A * | 5/1999 | Hutchings | 702/145 |
| 5,909,088 | A | 6/1999 | Wut | 315/200 A |
| 5,969,479 | A | 10/1999 | Wong | 315/200 A |
| 6,000,149 | A | 12/1999 | Pomerantz | 36/139 |
| 6,012,822 | A | 1/2000 | Robinson | 362/103 |
| RE37,220 | E | 6/2001 | Rapisarda et al. | 362/189 |
| 6,278,378 | B1 | 8/2001 | Feiner et al. | 340/815.45 |
| 6,286,975 | B1 | 9/2001 | Rodgers | 362/103 |
| 6,313,733 | B1 * | 11/2001 | Kyte | 340/573.1 |
| 6,422,911 | B1 | 7/2002 | Grzesek | 446/175 |
| 6,525,487 | B1 | 2/2003 | Wei | 315/200 A |
| 6,533,296 | B1 | 3/2003 | Farraday | 280/14.22 |
| 6,611,789 | B1 | 8/2003 | Darley | 702/160 |

(Continued)

FOREIGN PATENT DOCUMENTS

GB 2282521 A * 12/1995

(Continued)

*Primary Examiner*—Alan Cariaso
(74) *Attorney, Agent, or Firm*—Gray-Robinson, PA

(57) ABSTRACT

An article of footwear such as a shoe having an array of light sources and at least one loudspeaker is provided in combination with a separate device having a recording unit which records sound and a transmitter which transmits an RF signal representative of the sound recording to the shoe where a circuit operates the loudspeaker in the shoe to reproduce the recorded sound.

4 Claims, 6 Drawing Sheets

U.S. PATENT DOCUMENTS

| | | | | |
|---|---|---|---|---|
| 7,049,954 | B1 * | 5/2006 | Terry | 340/539.11 |
| 2001/0052848 | A1 * | 12/2001 | Lewis | 340/539 |
| 2002/0002863 | A1 | 1/2002 | Slycke et al. | 73/488 |
| 2002/0103447 | A1 | 8/2002 | Terry | 600/595 |
| 2002/0152645 | A1 | 10/2002 | Darley et al. | 36/136 |
| 2003/0163283 | A1 | 8/2003 | O'Brien | 702/160 |

FOREIGN PATENT DOCUMENTS

| | | |
|---|---|---|
| GB | 2 352 551 A | 1/2001 |
| WO | WO 98/42220 | 10/1998 |

* cited by examiner

ARTICLE OF FOOTWEAR WITH REMOTE SOUND ACTIVATING UNIT

FIELD OF THE INVENTION

This invention relates to an article of footwear, and, more particularly, to an article of footwear such as a shoe having an array of light sources and a loudspeaker in combination with a recorder/transmitter unit which records sound and then transmits an RF signal representative of the sound recording to the shoe where an electrical circuit operates the loudspeaker in the shoe to reproduce the recorded sound.

BACKGROUND OF THE INVENTION

For a number of years, articles of footwear and various items of clothing have been sold with decorative arrays of light sources such as light emitting diodes (LEDs) and/or a loudspeaker capable of producing a sound. This has been particularly popular in children's shoes where the LEDs are arranged to complement other design elements of the shoe such as cartoon characters and the like.

In a typical design of a children's shoe of the type noted above, a module including a plastic housing is placed in a cavity usually formed in the heel area of the shoe. The module mounts a battery, a switch and conventionally an integrated circuit which is connected by wires to LEDs positioned along the outsole, upper or tongue of the shoe. The integrated circuit may also be capable of generating a signal operative to sound a loudspeaker, typically mounted in the upper or tongue of the shoe in the general area of the LEDs. Systems of this type are shown, for example, in U.S. Pat. Nos. 6,525,487; 6,286,975; 6,012,822; 5,969,479; 5,894,201; 5,812,063 and others.

The integrated circuits employed in modules for children's shoes and other applications are conventionally activated by one or more switches carried on or otherwise coupled to the module. In some designs, the switch turns on and off in response to the application of an inertia force, pressure or motion. Spring switches such as disclosed in U.S. Pat. Nos. RE37,220 and 5,909,088 are a popular choice for children's shoes because they are reliable, noiseless and movable from a neutral or off position to a closed or on position in response to walking, running or other motion of the shoe. Pressure switches such as shown in U.S. Pat. Nos. 5,159,768; 5,649,376; 5,855,080 and 5,714,706 are also employed and they operate in response to the application of a weight, e.g. when the child steps onto a surface.

Another type of switch employed in children's shoes and similar applications is a manually activated switch such as shown in U.S. Pat. Nos. 5,894,686; 6,278,378 and 5,813,148. Manual switches are employed to turn on and off the light source carried by the shoe, to select different modes of operation for the integrated circuit associated with the shoe, e.g. different flashing sequences or other operations, and for other purposes. Some systems, such as disclosed in the U.S. Pat. No. 5,813,148 patent, employ both manual and inertia switches to activate light sources and/or sound sources associated with the shoe. In the '148 system, the manual switch turns on and off a light source, and also causes a controller including an integrated circuit to activate a particular mode of operation. One of the modes of operation enables an inertia or pressure sensitive switch, which then operates to activate the light source in a selected flashing sequence.

All of these arrangements involve either the "automatic" activation of the light sources and/or loudspeaker(s) in the sense that an inertia, pressure or motion switch operates without manual intervention, or, alternatively, manual switches associated with the shoe can be operated to activate the light sources and loudspeakers. In either case, a switch or switches carried by the shoe cause the light sources or loudspeaker to operate.

SUMMARY OF THE INVENTION

This invention is directed to a system which includes an article of footwear such as a shoe having one or more light sources and a loudspeaker in combination with a remote, recorder/transmitter device which records sound and then transmits an RF signal representative of the sound recording to the shoe where an electrical circuit operates the loudspeaker in the shoe to reproduce the recorded sound.

This invention is predicated on the concept of providing an interactive system for the enjoyment of younger children which allows them to remotely record sounds and then cause the recorded sounds to be played back by the shoes they are wearing. In the presently preferred embodiment, a sound recording unit, a transmitter, a power source, and, optionally, one or more LEDs, are carried within a housing which can be mounted to the wrist of the user or otherwise placed in a position to be manipulated by hand. The child or other user records whatever message or sound he or she desires by operating a record button on the recording unit, which can be played back and edited as desired. In response to operation of a switch, the recorded message or other sound is converted by the transmitter to an RF signal representative of such message and then transmitted to the shoe.

The shoe mounts an array of LEDs, one or more loudspeakers and an electrical circuit having an RF receiver. The array of LEDs is operated in the conventional manner, e.g. in a flashing sequence responsive to operation of an inertia switch, pressure switch, motion switch or the like mounted to the shoe. When an RF signal is produced by the transmitter, it is sensed by the RF receiver in the shoe and, in turn, the loudspeaker(s) in the shoe are sounded to reproduce the recorded message or sound.

The system of this invention provides an element of fun and interaction of children. He or she can control the message or sounds produced by the shoe, both in terms of content and when such sounds are played, and the LEDs or other light sources are operated by walking, running or other movement of the shoes.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
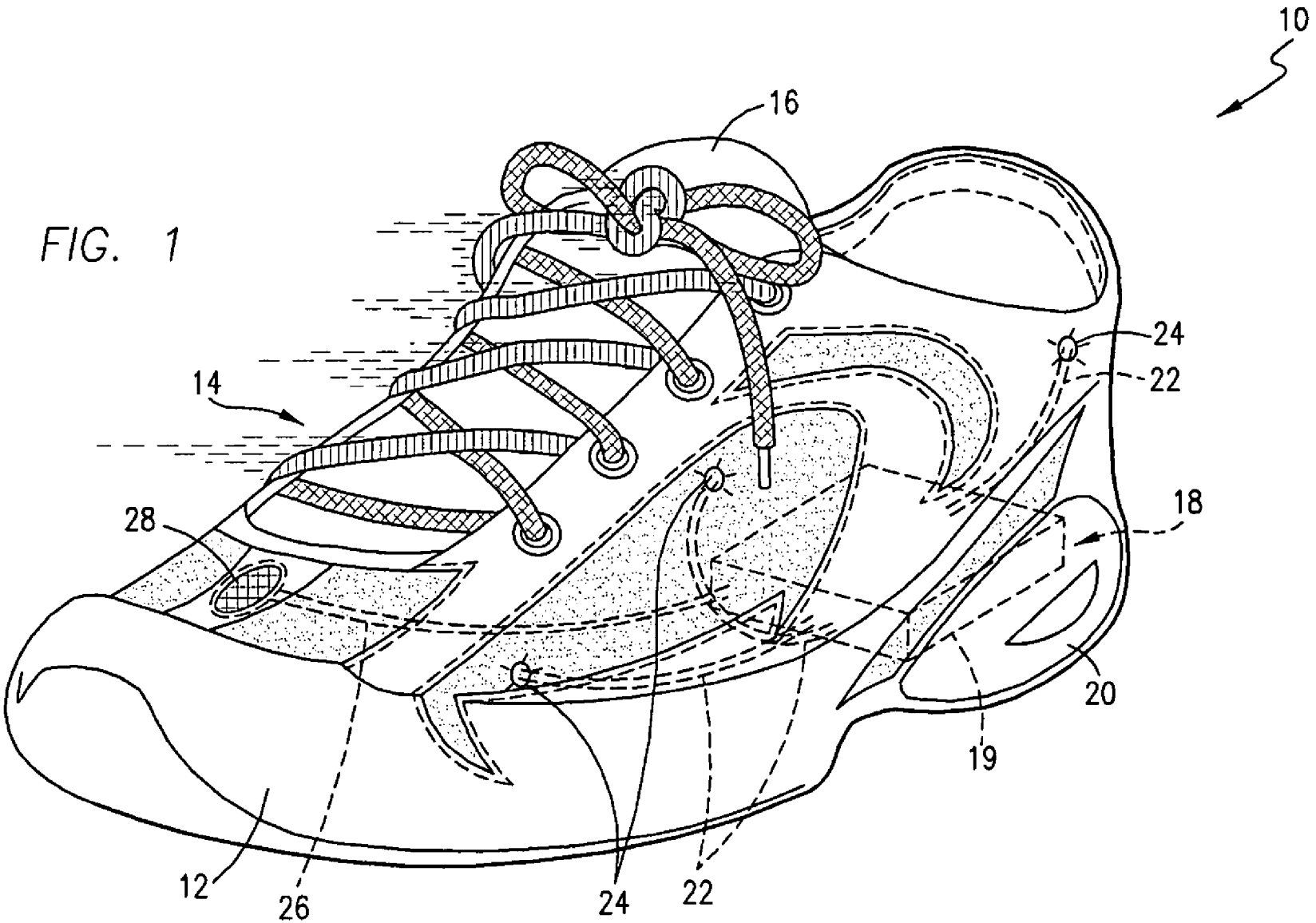
FIG. 1 is a perspective view of a shoe having an upper carrying a module which is connected to an array of LEDs and to a loudspeaker both mounted to the upper of the shoe.

Referring initially to FIG. 1, a shoe 10 is shown having an outsole 12 connected to an upper 14 including a tongue 16. It should be understood that essentially any other article of footwear is considered within the scope of this invention, and the shoe 10 is shown for purposes of illustration. As such, the term "upper" is meant to broadly encompass essentially any shoe element mounted to the outsole of an article of footwear such as the straps of a sandal, etc.

A module 18 having a housing 19 preferably made of plastic is mounted in the heel 20 of the shoe 10. A cavity (not shown) is hollowed out of the heel 20 to receive the module 18, over which the sock liner or insole of the shoe 10 is secured. As schematically illustrated in FIG. 1, the module 18 is connected by wires 22 to an array of LEDs 24 mounted to the upper 14 of the shoe 10, and by a wire 26 to a loudspeaker 28 also carried by the upper 14. As described below in connection with a discussion of FIGS. 5 and 7, the module 18 mounts an electrical circuit 50 which controls the operation of the LEDs 24 and loudspeaker 28. The particular location or arrangement of the LEDs 24 on the shoe 10 is a matter of choice, and it is contemplated they could be placed on the outsole 12, upper 14, tongue 16 or in essentially any other position on the shoe 10. The loudspeaker 28 is preferably mounted to the tongue 16 or some area of the upper 14, rather than on the outsole 12.

Figure 2:
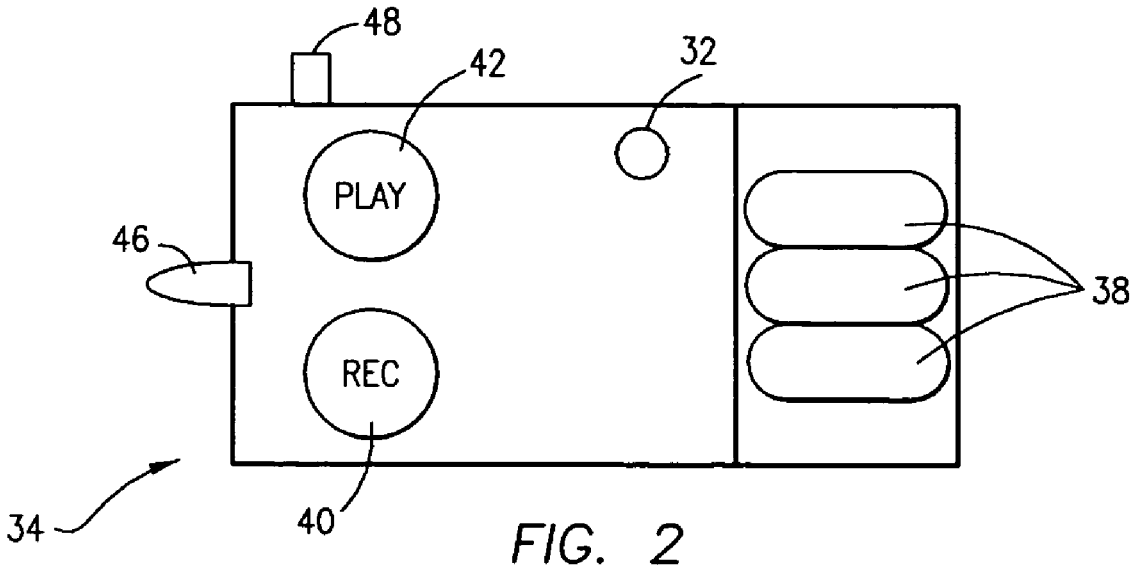
FIG. 2 is a front view of the recording unit of this invention.
Figure 3:
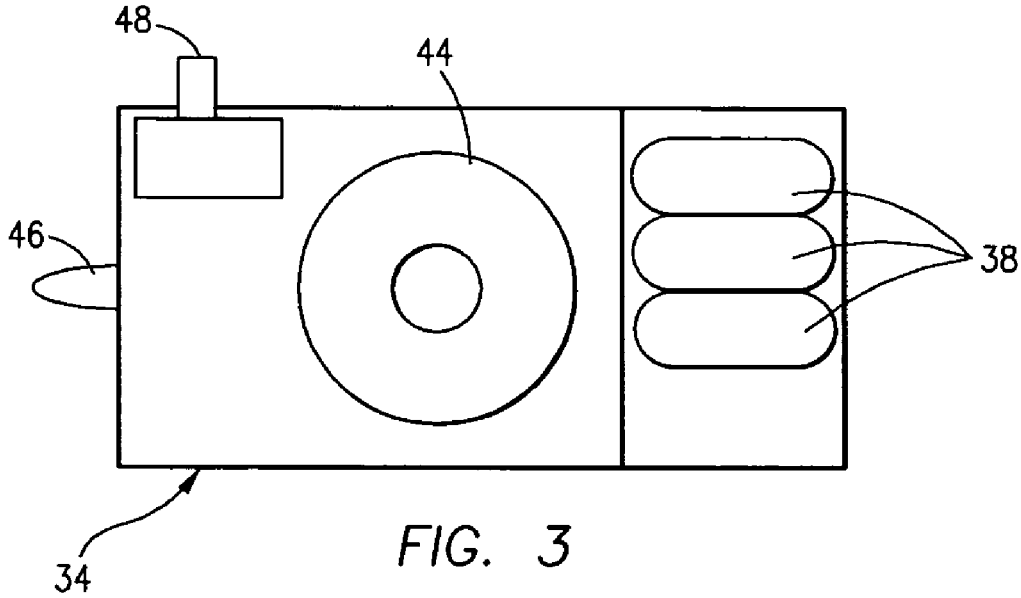
FIG. 3 is a back view of the recording unit shown in FIG. 2.
Figure 4:
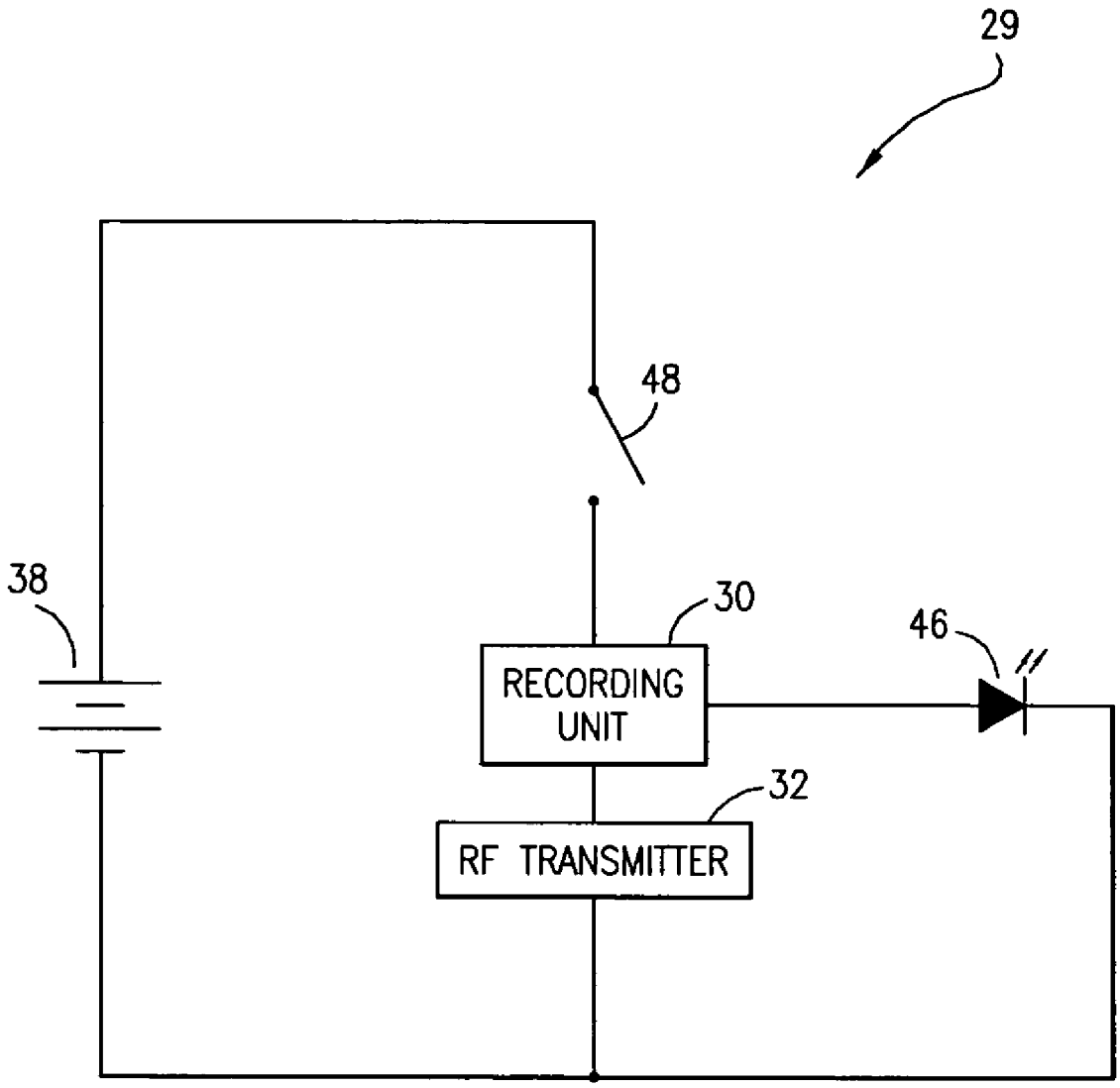
FIG. 4 is a schematic block diagram of the electrical circuit housed in the recording unit.

Referring now to FIGS. 2–4, an electrical circuit 29 is schematically depicted which includes two main parts: a recording unit 30 and an RF transmitter 32 carried within a housing 34. Both the recording unit 30 and transmitter 32 are coupled to one or more batteries 38. The recording unit 30 has a "record" button 40 and "play" button 42, and is coupled to a loudspeaker 44. Preferably, an LED 46 is provided which illuminates when the record button 40 is depressed. The recording unit 30 operates in a conventional manner, e.g. it records sound when the record button 40 is depressed, and plays it back when the play button 42 is activated. The recording unit 30 is also coupled to a switch 48, which, as described more fully below in connection with a discussion of FIG. 5, causes the transmitter 32 to emit an RF signal representative of the message or sound recorded by the recorder 34.

Figure 5:
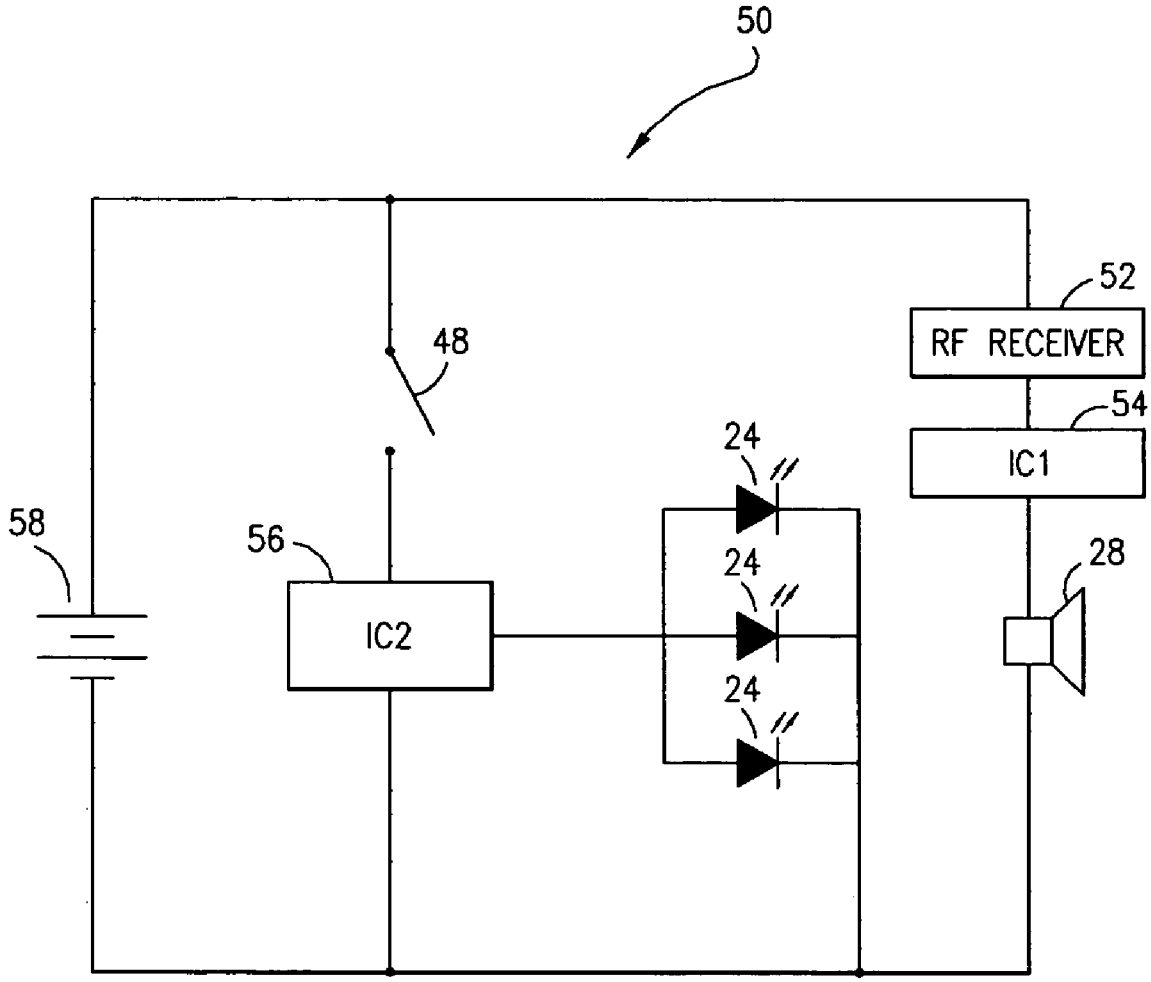
FIG. 5 is a schematic block diagram of the electrical circuit in the shoe.

With reference initially to FIG. 5, an electrical circuit 50 is housed in the module 18 of the shoe 10 which generally comprises three parts, namely, and RF receiver 52, a sound producing portion including an integrated circuit (IC 1) 54 and the loudspeaker 28, and, a light producing portion including an integrated circuit (IC 2) 56 and the LEDs 24. One or more batteries 58 are included in the circuit 50 to provide power. As described in more detail below in connection with a discussion of FIG. 7, the RF receiver 52 is operative to activate the IC 54, and, hence, the loudspeaker 28 upon receipt of a signal from the RF transmitter 32. The LEDs 24 are illuminated by the IC 56 in response to opening or closing of a switch 48, which may be an inertia, motion or pressure switch, mounted to the shoe 10 or to the module 18.

Figure 6:
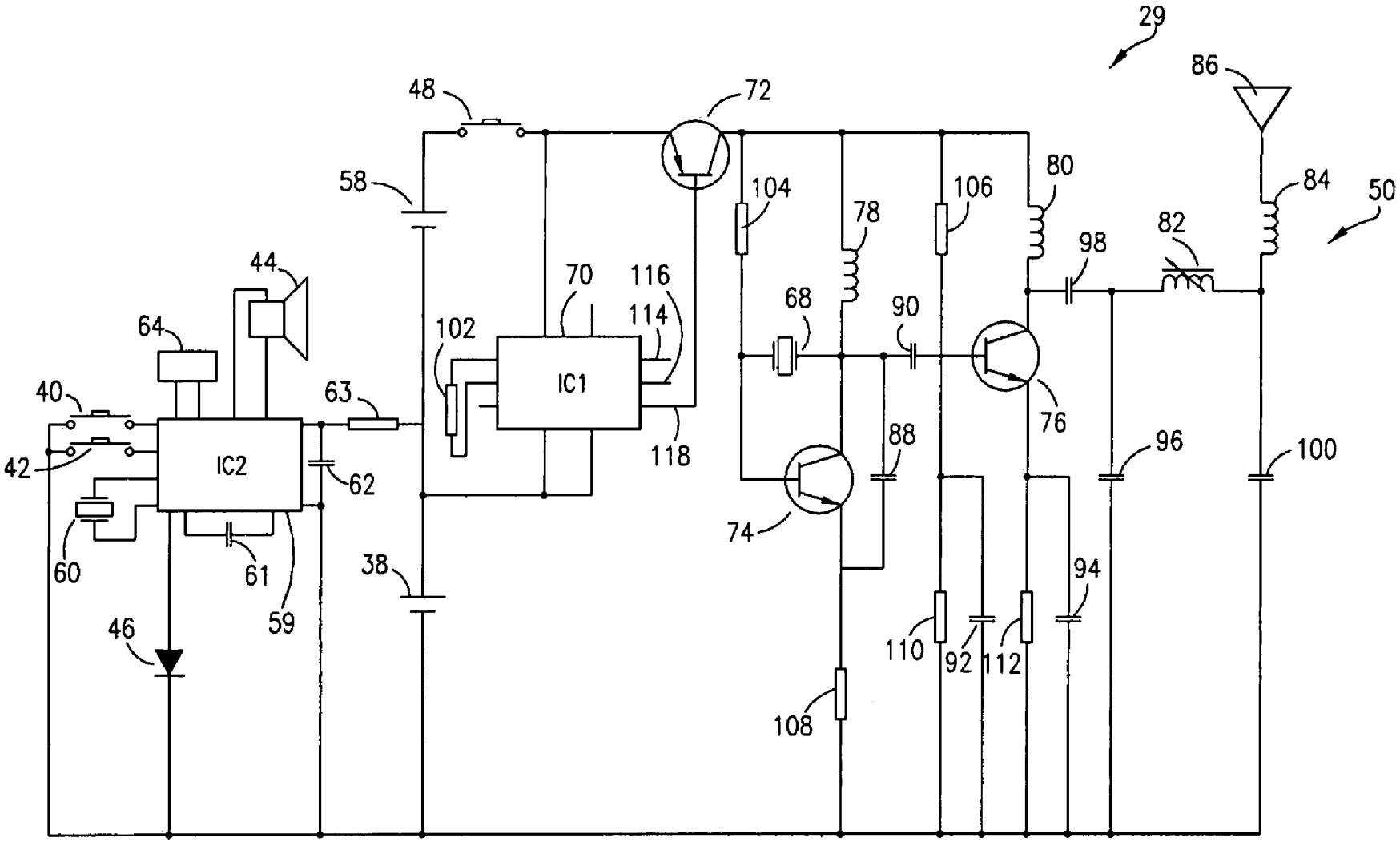
FIG. 6 is a more detailed view of the electrical circuit which produces an RF signal.

Referring now to FIG. 6, one presently preferred embodiment of the electrical circuit 29 depicted schematically in FIG. 4 is shown in more detail. It is contemplated that other circuit configurations could be employed to record sound and then produce and RF signal representative of such recorded sound, and therefore this invention is not intended to be limited to the particular circuit shown.

As noted above, circuit 29 has two parts, namely, a recording unit 30 and an RF transmitter 32. The recording unit 30 includes a recording integrated circuit (IC) 59 a crystal 60, the speaker 44, the record button 40 and play button 42, the battery 38, two capacitors 61 and 62, a resistor 63 and a microphone 64. The RF transmitter 32 of the circuit 29 generally includes a crystal 68; the switch 48; an IC 70; three transistors 72, 74 and 76; four inductors 78, 80, 82 and 84; an antenna 86; the battery 58; seven capacitors 88, 90, 92, 94, 96, 98 and 100; and, six resistors 102, 104, 106, 108, 110 and 112.

The recording unit 30 is in a standby mode when connected to battery 38, and is activated by pressing the record button 40. After speaking into the microphone 64 or making other sounds, the record button 40 is pressed again to stop the recording and play button 42 may be pressed to play back the recorded message or other sound. While the record button 40 is depressed, the recording IC 59 illuminates the LED 46.

The recording IC 59 is operative to produce a signal which is representative of the recorded sound. The signal is transmitted to the IC 70 within the RF transmitter 32 portion of circuit 20. When the IC 70 is activated its LED outputs 114, 116 and 118 change from high to low. Since output 118 is connected to the base of transistor 72, the IC 70 causes the transistor 72 to conduct allowing a flow of current from battery 58 to flow to the resistor 104 and inductor 78. The current passing through the resistor 104 flows to the base of transistor 74 causing it to conduct as well. The resistor 104 and inductor 78 are chosen with different resistances to create a potential across the crystal 68 causing it to generate voltage having a frequency of approximately 27.145 Hz. This voltage passes through capacitor 90 to the base of transistor 76 causing it to conduct. The voltage is amplified by transistor 76 according to its gain, and then filtered by capacitors 96, 98 and 100, and the inductor 82, so that a substantially pure frequency of 27.145 is delivered to the antenna 86 for transmission to the electrical circuit 50 in the shoe 10.

Figure 7:
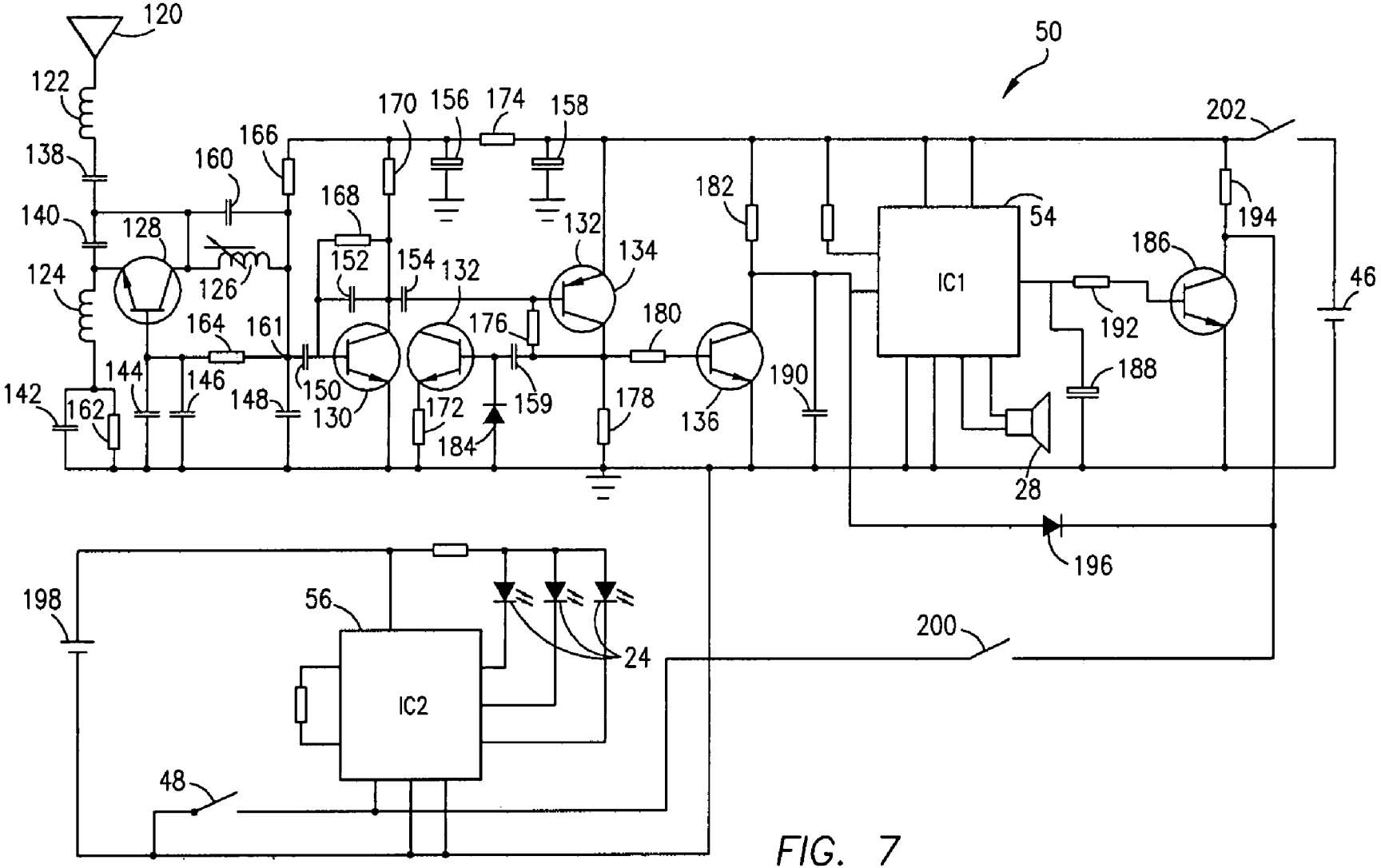
FIG. 7 is a more detailed view of the electrical circuit located in the shoe.

Referring now to FIG. 7, details of the electrical circuit 50 contained in the shoe 10 are shown. As noted above, the circuit 50 consists of three main elements, i.e. the RF receiver 52, the sound generating portion including IC 54 and the light generating portion including IC 56. The RF receiver generally includes an antenna 120; three inductors 122, 124 and 126; five transistors 128, 130, 132, 134 and 136; several capacitors 138, 140, 142, 144, 146, 148, 150, 152, 154, 156, 158, 159 and 160; several resistors 162, 164, 166, 168, 170, 172, 174, 176, 178, 180 and 182; and a diode 184. The sound generating portion of the circuit 50 generally includes the sound IC 54; loudspeaker 28; a transistor 186; two capacitors 188, 190; resistors 192, 194; and, a diode 196. The light producing portion of the circuit 29 generally includes the light IC 56, the inertia, motion or pressure switch 48, LEDs 24 and a battery 198.

The light producing portion of the circuit 50 operates in a known manner. In response to movement of the shoe 10, such as by walking or running, the switch 48 operates to activate light IC 64, which, in turn, illuminates the LEDs 24 in a selected flashing pattern, or essentially any other type of lighting sequence.

The sound producing portion of the circuit 50 is dependent on the production of an RF signal from the transmitter 32 associated with the remote unit, the receipt of such signal by the receiver portion of circuit 50 and resulting production of a trigger signal input to the sound IC 54. Initially, when switches 200 and 202 close, provided antenna 120 does not receive a 27.145 Hz radio frequency signal, transistor 136 continues conducting and its collector, which is connected to the trigger terminal of integrated circuit 54, remains at a low potential thereby keeping integrated circuit 54 deactivated so that speaker 28 does not sound. When antenna 120 receives a radio frequency signal from transmitter 32, inductor 122 and capacitor 138 resonate at a high frequency voltage which induces a high frequency voltage causing a high frequency current to flow through inductor 124 and the network formed by capacitor 142 and resistor 162. As a result, the base voltage of transistor 128 transitions from low to high, causing transistor 128 to conduct. Conduction of transistor 128 causes inductor 126 and capacitor 160 to resonate at their resonant frequency, thereby causing the node 161 between resistor 164 and capacitor 150 to alternatively transition from a high potential to a low potential and vice versa.

When node 161 is at a low potential, transistor 130 does not conduct. When transistor 130 is not conducting, its collector is at a high potential which keeps transistor 132 conducting. This holds the base of transistor 134 at a high potential which prevents transistor 134 from conducting. When transistor 134 does not conduct, its collector remains at a low potential thereby stopping transistor 136 from conducting. When transistor 136 stops conducting, its collector voltage changes from low to high, thereby triggering integrated circuit 54 causing speaker 28 to sound.

Conversely, when the potential at node 161 is high, transistor 130 conducts due to the high potential at its base. Conduction of transistor 130 pulls the collector of transistor 132 low, thereby causing transistor 132 to stop conducting. Conduction of transistor 46 in turn pulls the base of transistor 134 low, causing transistor 134 to conduct. Conduction of transistor 134 makes the voltage at the collector of transistor 134 and the base of transistor 136 assume a high voltage which causes transistor 136 to conduct. Conduction of transistor 136 pulls its collector low which prevents integrated circuit 54 from triggering.

The particular sound produced by the speaker 28 in response to the signal from IC 54 is a matter of choice, and is intended to add to the enjoyment of the interactive system of this invention. As noted above, instead of causing a speaker in the shoe of the wearer to sound in response to the "automatic" activation of a switch in the shoe (e.g., inertia, motion, pressure, etc.) or a manually activated switch, the present invention provides for remote activation of the speaker via RF signals transmitted from the transmitter 32 contained in the housing 34 of a remote unit which can be worn, e.g., on a wrist band or the like, or is otherwise capable of being manipulated by hand.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. An apparatus, comprising:

a unit adapted to be manipulated by a user, said unit having a first electrical circuit including:

(i) a recording unit capable of recording sound and playing back the recorded sound;

(ii) a first switch;

(iii) a transmitter coupled to said first switch and to said recording unit, said transmitter being effective to produce an RF signal representative of the sound recorded by said recording unit, and to transmit said RF signal in response to activation of said first switch;

an article of footwear;

a second electrical circuit mounted to said article of footwear, including:

(i) at least one light source;

(ii) a first integrated circuit coupled to said at least one light source;

(iii) a second switch coupled to said first integrated circuit, said first integrated circuit being effective to illuminate said at least one light source in response to operation of said second switch;

(iv) a loudspeaker;

(v) a second integrated circuit coupled to said loudspeaker;

(vi) a receiver operative to receive said RF signal from said transmitter, and then cause said second integrated circuit to sound said loudspeaker.

2. The system of claim 1 in which said first electrical circuit further includes a source of light which illuminates while said recorder is recording sound.

3. The system of claim 1 in which said second switch is an inertia switch.

4. The system of claim 1 in which said recording unit includes a loudspeaker and a microphone.

* * * * *